US009152101B2

(12) United States Patent
Russel et al.

(10) Patent No.: US 9,152,101 B2
(45) Date of Patent: Oct. 6, 2015

(54) PRINTER DEVICE USING INTER-DOCUMENT GAP TO REDUCE MOTION DISTURBANCE AND METHOD THEREOF

(71) Applicants: Xerox Corporation, Norwalk, CT (US); Chester Paul Maliszewski

(72) Inventors: Steven M Russel, Bloomfield, NY (US); Charles Bennett, Hilton, NY (US); John R Falvo, Ontario, NY (US); Robert Joseph Rinefierd, III, Fairport, NY (US); Eliud Robles Flores, Webster, NY (US)

(73) Assignee: Xerox Corporation, Norwalk, CT (US)

( * ) Notice: Subject to any disclaimer, the term of this patent is extended or adjusted under 35 U.S.C. 154(b) by 0 days.

(21) Appl. No.: 14/093,879

(22) Filed: Dec. 2, 2013

(65) Prior Publication Data

US 2015/0153689 A1 Jun. 4, 2015

(51) Int. Cl.
*G03G 15/20* (2006.01)
*G03G 15/00* (2006.01)

(52) U.S. Cl.
CPC ..... *G03G 15/2028* (2013.01)

(58) Field of Classification Search
USPC ..... 399/68, 397, 400, 322, 325
See application file for complete search history.

(56) References Cited

U.S. PATENT DOCUMENTS

| | | | | |
|---|---|---|---|---|
| 5,600,424 | A * | 2/1997 | Malachowski | 399/68 |
| 5,729,818 | A * | 3/1998 | Ishizuka et al. | 399/400 |
| 7,157,873 | B2 | 1/2007 | Carolan et al. | |
| 8,511,816 | B2 | 8/2013 | Moore | |
| 2005/0169683 | A1 * | 8/2005 | Tanaka | 399/400 |
| 2006/0024096 | A1 * | 2/2006 | Kimura | 399/325 |
| 2009/0085280 | A1 * | 4/2009 | Litman et al. | 271/186 |
| 2010/0303488 | A1 * | 12/2010 | Yanagi | 399/45 |
| 2012/0020714 | A1 * | 1/2012 | Cardoso et al. | 399/400 |
| 2012/0075395 | A1 * | 3/2012 | Moore | 347/104 |

FOREIGN PATENT DOCUMENTS

JP 2011186150 A * 9/2011

* cited by examiner

*Primary Examiner* — David Gray
*Assistant Examiner* — Tyler Hardman
(74) *Attorney, Agent, or Firm* — Simpson & Simpson, PLLC

(57) ABSTRACT

A printing device, including a fuser section for printing operations and first and second fuser rollers for the fuser section arranged to: displace a plurality of sheets of print material in a process direction; and substantially simultaneously disengage from a trailing edge of a first sheet from the plurality of sheets; and engage a leading edge of a second sheet from the plurality of sheets. A printing device, including: a fuser section for printing operations and including first and second fuser rollers; a motor arranged to rotate the first and second fuser rollers to displace a plurality of sheets of material in a process direction; and a control system configured to measure a torque produced by the motor and according to a value of the measured torque, control a speed at which the first and second fuser rollers displace the plurality of sheets of print material in the process direction.

30 Claims, 8 Drawing Sheets

PRINTER DEVICE USING INTER-DOCUMENT GAP TO REDUCE MOTION DISTURBANCE AND METHOD THEREOF

TECHNICAL FIELD

The present disclosure relates to a device and method for controlling a speed at which a fuser section of a printer device displaces sheets of material to coordinate disengagement of a sheet of material from rollers for the fuser section with engagement of a next sheet in sequence with the fuser rollers. In particular, the device and method reduce an inter-document gap for a sheet having a length greater than a distance between the fuser rollers and a transfer roller in a photoreceptor section.

BACKGROUND

FIG. 4 is a schematic diagram of prior art printer device 200. Device 200 includes photoreceptor belt PBR, fuser section 202, transfer device 204, and prefuser transports PT arranged to move sheets of material S in process direction P from transfer device 204 to fuser section 202. Section 202 includes fuser rollers 206 and 208 arranged to displace sheets in direction P.

FIG. 5 is a graph showing torque load TL on a motor driving fuser rollers 206 and 208. FIG. 5 shows load TL as a sheet enters and exits rollers 206 and 208. Torque spike TL-1 occurs when the sheet engages rollers 206 and 208. Torque spike TL-2 occurs when the sheet disengages from rollers 206 and 208. As a thickness of sheet S increases, respective amplitudes of spikes TL-1 and TL-2 increase. If the thickness is large enough, respective jolts are caused by engagement of the sheet with rollers 206 and 208 disengagement of the sheet from rollers 206 and 208. These jolts cause undesirable disturbance in a photoreceptor section (not shown) with subsequent image artifacts.

FIG. 6 is a graph showing fuser drive velocity DV for fuser section 202. DV is substantially a mirror of TL. Spike DV-1 occurs with spike TL-1 and spike DV-2 occurs with spike TL-2. As a thickness of sheet S increases, respective amplitudes of spikes DV-1 and DV-2 increase. Further, increasing the thickness of sheet S delays the time at which a trailing edge of the sheet disengages from the fuser rollers.

Another problem associated with device 200 is increasing length L of sheet S to be greater than distance D between transfer device 204 and rollers 206 and 208, that is, sheet S is simultaneously engaged by roller the transfer device and rollers 206 and 208. Such simultaneous engagement causes undesirable image artifacts. Further, to prevent crumpling or distorting sheet S, the transfer device and fuser rollers 206 and 208 must displace sheet S at the same rate. In addition, an inter-document zone IDZ is typically maintained between sheets to facilitate test patterns and other quality control operations in photoreceptor section 202.

SUMMARY

According to aspects illustrated herein, there is provided a printing device, to including a fuser section useful for printing operations and first and second fuser rollers for the fuser section arranged to: displace a plurality of sheets of print material in a process direction; and substantially simultaneously disengage from a trailing edge of a first sheet from the plurality of sheets; and engage a leading edge of a second sheet from the plurality of sheets.

According to aspects illustrated herein, there is provided a printing device, including a photoreceptor section arranged to displace a plurality of sheets of material at a constant speed in a process direction and fuser section useful for printing and having first and second fuser rollers arranged to: displace a plurality of sheets of print material in the process direction; vary a speed at which the first and second fuser rollers displace the plurality of sheets in the process direction; and substantially simultaneously disengage, from the first and second fuser rollers, a trailing edge of a first sheet in the plurality of sheets and engage, with the first and second fuser rollers, a leading edge of a second sheet from the plurality of sheets.

According to aspects illustrated herein, there is provided a printing device, including a photoreceptor section and a fuser section useful for printing and having first and second fuser rollers. The photoreceptor section is arranged to displace, in a process direction toward the first and second fuser rollers, first and second sheets of print material and create or maintain a first distance, in the process direction, between a trailing edge of the first sheet and a leading edge of the second sheet. The first and second fuser rollers are arranged to reduce a speed at which the first and second fuser rollers displace the first sheet in the process direction, reduce the first distance between the first and second sheets to a second distance between the first and second sheets and substantially simultaneously disengage a trailing edge of the first sheet from the first and second fuser rollers and engage a leading edge of a second sheet of the print material with the first and second fuser rollers.

According to aspects illustrated herein, there is provided a printing device, including: a fuser section useful for printing operations and including first and second fuser rollers; a motor arranged to rotate the first and second fuser rollers to displace a plurality of sheets of material in a process direction; and a control system configured to measure a torque produced by the motor and according to a value of the measured torque, control a speed at which the first and second fuser rollers displace the plurality of sheets of print material in the process direction.

According to aspects illustrated herein, there is provided a method for operating a printing device including a fuser device useful in printing and having first and second fuser rollers, including: displacing, with the first and second fuser rollers, a plurality of sheets of print material in a process direction; and substantially simultaneously disengage, from the first and second fuser rollers, a trailing edge of a first sheet from the plurality of sheets and engage, with the first and second fuser rollers, a leading edge of a second sheet from the plurality of sheets.

According to aspects illustrated herein, there is provided a method for operating a printing device including a photoreceptor section, and a fuser section useful for printing and having first and second fuser rollers, the method including: displacing a plurality of sheets of print material in a process direction with the photoreceptor section; varying a speed at which the first and second fuser rollers displace the plurality of sheets in the process direction; and substantially simultaneously disengaging, from the first and second fuser rollers, a trailing edge of a first sheet in the plurality of sheets and engaging, with the first and second fuser rollers, a leading edge of a second sheet from the plurality of sheets.

According to aspects illustrated herein, there is provided a method for operating a printing device including a photoreceptor section, and a fuser section useful for printing and having first and second fuser rollers, the method including: displacing, in a process direction toward the first and second fuser rollers, first and second sheets of print material with the photoreceptor section; creating or maintaining a first distance, in the process direction, between a trailing edge of the first sheet and a leading edge of the second sheet; reducing a speed at which the first and second fuser rollers displace the first sheet in the process direction; reducing the first distance between the first and second sheets to a second distance between the first and second sheets; and substantially simultaneously disengaging a trailing edge of the first sheet from the first and second fuser rollers and engaging a leading edge of a second sheet of the print material with the first and second fuser rollers.

According to aspects illustrated herein, there is provided a method for operating a printing device including a fuser section useful for printing and having first and second fuser rollers and a motor for rotating the first and second fuser rollers, the method including: rotating the first and second fuser rollers; displacing, with the first and second fuser rollers, first and second sheets of material, from a plurality of sheets of material, in a process direction; measuring a torque produced by the motor; and according to a value of the measured torque, controlling a speed at which the first and second fuser rollers displace at least a portion of the plurality of sheets of print material in the process direction.

BRIEF DESCRIPTION OF THE DRAWINGS

Various embodiments are disclosed, by way of example only, with reference to the accompanying schematic drawings in which corresponding reference symbols indicate corresponding parts, in which.

DETAILED DESCRIPTION

Moreover, although any methods, devices or materials similar or equivalent to those described herein can be used in the practice or testing of these embodiments, some embodiments of methods, devices, and materials are now described.

Figure 1A:
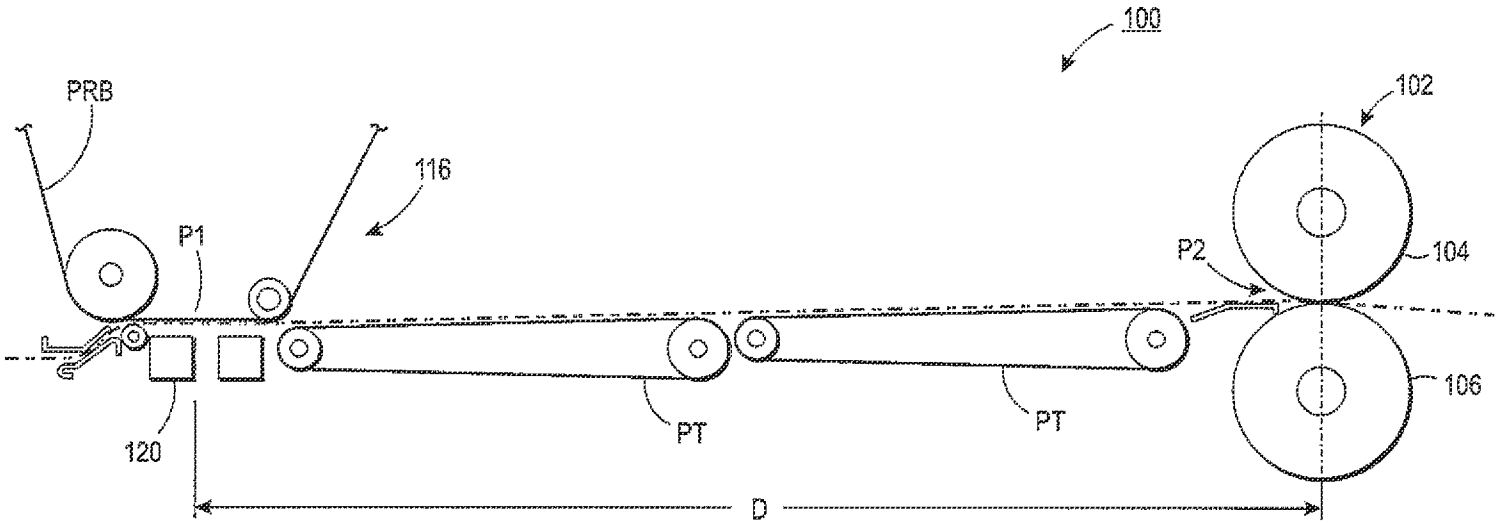
FIG. 1A is a schematic diagram of a printer device, with an electro-static transfer device, using an inter-document gap to reduce motion disturbance.

FIG. 1A is a schematic diagram of printer device 100, with an electro-static transfer device, using an inter-document gap to reduce motion disturbance.

Figure 1B:
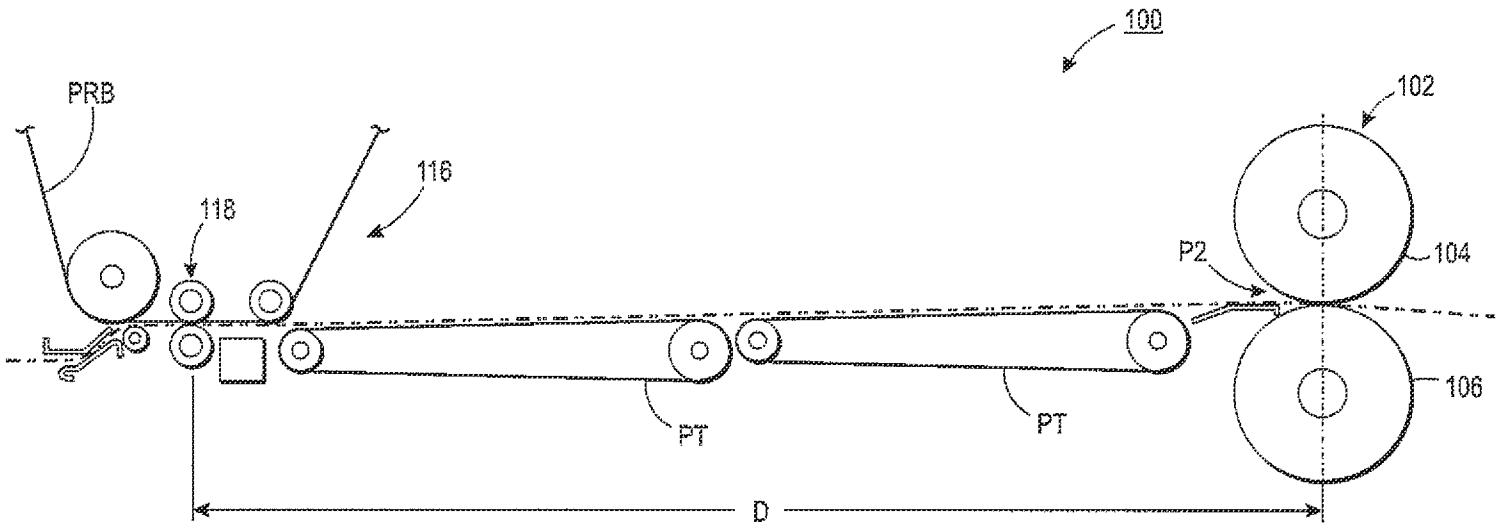
FIG. 1B is a schematic diagram of a printer device, with dual roller transfer device, using an inter-document gap to reduce motion disturbance.

FIG. 1B is a schematic diagram of printer device 100, with dual roller transfer device, using an inter-document gap to reduce motion disturbance.

Figure 2A:
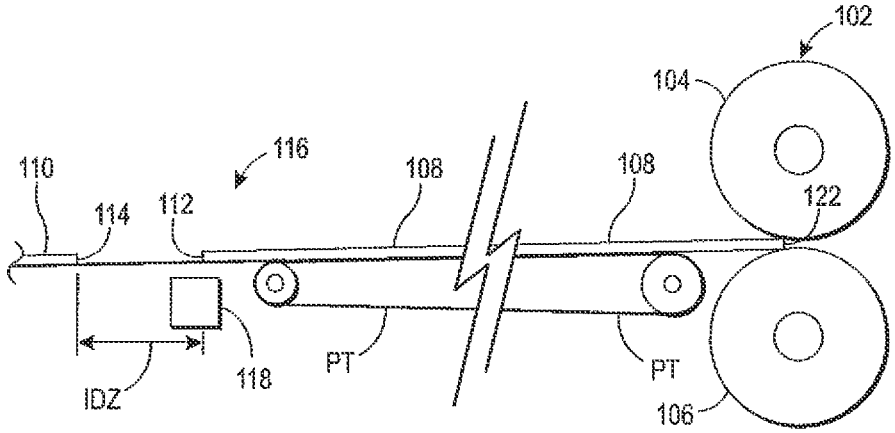
FIG. 2A is a schematic detail of the printer device in FIG. 1A showing a sheet engaging fuser rollers and a transfer roller.

FIG. 2A is a schematic detail of printer device 100 in FIG. 1A showing a sheet engaging fuser rollers and a transfer roller.

Figure 2B:
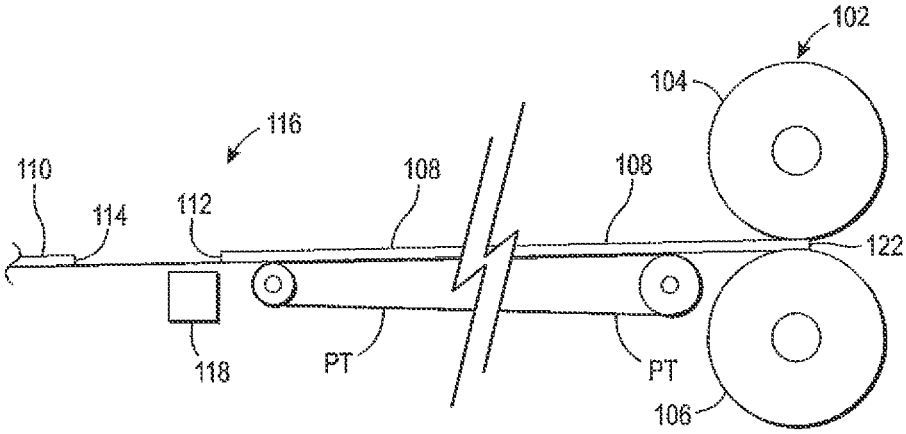
FIG. 2B is a schematic detail of the printer device in FIG. 1A showing the sheet disengaging from the transfer roller.

FIG. 2B is a schematic detail of printer device 100 in FIG. 1A showing the sheet disengaging from the transfer roller.

Figure 2C:
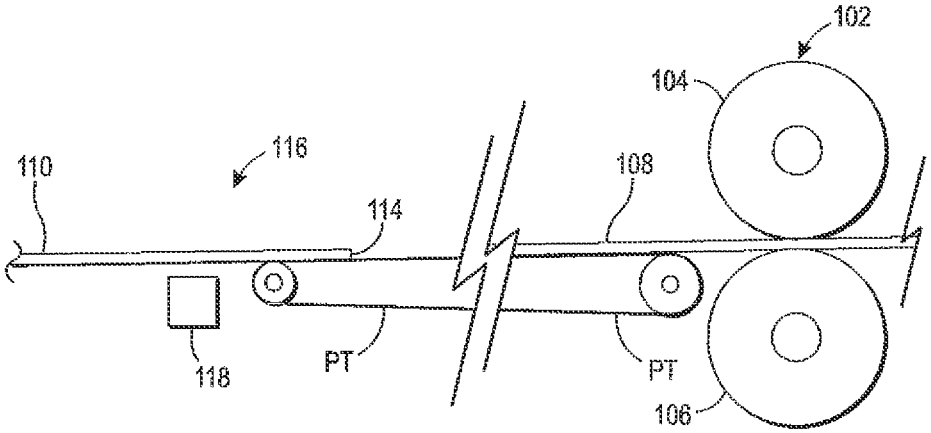
FIG. 2C is a schematic detail of the printer device in FIG. 1A showing the sheet being displaced by the fuser rollers and a next sheet in a sequence of sheets sheet being displaced by the photoreceptor section and engaged with a transfer roller.

FIG. 2C is a schematic detail of printer device 100 in FIG. 1A showing the sheet being displaced by the fuser rollers and a next sheet in a sequence of sheets sheet being displaced by the photoreceptor section and engaged with a transfer roller.

Figure 2D:
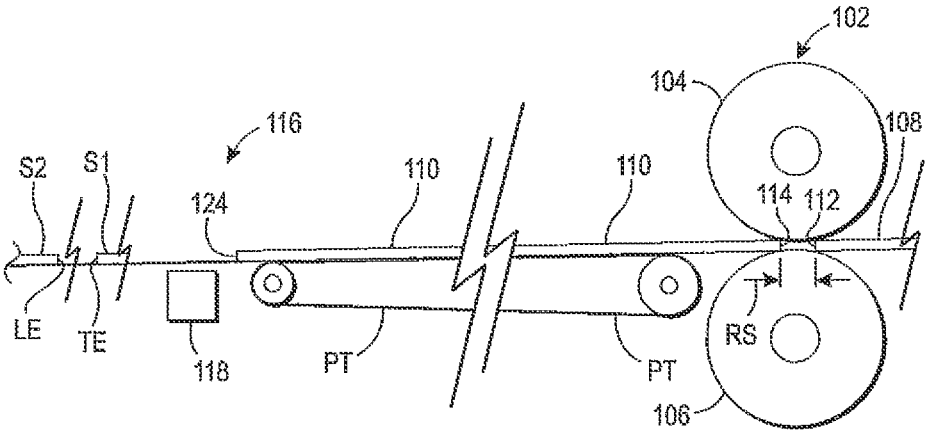
FIG. 2D is a schematic detail of the printer device in FIG. 1A showing the next sheet engaging the fuser rollers while the sheet is disengaging from the fuser rollers.

FIG. 2D is a schematic detail of printer device 100 in FIG. 1A showing the next sheet engaging the fuser rollers while the sheet is disengaging from the fuser rollers. The following should be viewed in light of FIGS. 1 through 2D. Printer device 100 includes fuser section 102, useful for printing operations. Section 102 includes fuser rollers 104 and 106 arranged to sheets of print material, such as sheets 108 and 110 (shown in FIGS. 2A through 2D) in process direction P. In the discussion that follows, sheets 108 and 110 are used as examples of two sheets in sequence being operated upon by printer device 110; however, it should be understood that in general the discussion is generally applicable to sheets being operated upon by printer device 100, in particular, successive sheets. Rollers 104 and 106 are arranged to substantially simultaneously disengage from a trailing edge of a sheet, for example, trailing edge 112 of sheet 108 and engage a leading edge of a next sheet in sequence, for example leading edge 114 of sheet 110, as shown in FIG. 2D. As further described below, the simultaneous disengagement and engagement reduces or eliminates the motion disturbances (jolts and drops) described above. That is, respective motions associated with the simultaneous disengagement and engagement attenuate or substantially cancel each other.

In an example embodiment, printer device 100 includes photoreceptor section 116 with transfer device 118 arranged to displace sheets, such as sheets 108 and 110, at a constant speed in process direction P toward fuser rollers 104 and 106. In an example embodiment, section 116 includes photoreceptor belt PRB and prefuser transports PT arranged to displace sheets, such as sheets 108 and 110, at a constant speed in process direction P toward fuser rollers 104 and 106. Device 118 can be any device known in the art. In FIG. 1A, device 118 is an electro-static transfer device. In FIG. 1B, device 118 is a dual-roller device.

Point P1 at which sheets of material disengage from transfer device 118 and point P2 at which sheets of material engaged rollers 104 and 106 are separated by distance D in direction P. Device 100 is arranged to operate upon sheets of material having a length L in direction P greater than distance D. Fuser rollers 104 and 106 are arranged to vary a speed at which fuser rollers 104 and 106 displace sheets 108 and 110 in process direction P. Fuser rollers 104 and 106 are arranged to grip, or engage, leading edge 122 of sheet 108 while sheet 108 is still engaged at transfer device 118 as shown in FIG. 2A (due to length L being greater than distance D), and to displace sheet 108 in process direction P at the constant speed while sheet 108 is still engaged with transfer device 118. When trailing edge 112 of sheet 108 disengages from transfer device 118 as shown in FIG. 2B, fuser rollers 104 and 106 are arranged to displace sheet 108 in process direction P at a speed less than the constant speed until leading edge 114 of sheet 110 is engaged by fuser rollers 104 and 106 as shown in FIG. 2C. The reduced speed is selected to enable the simultaneous engagement of edge 114 and disengagement of edge 112 noted above.

Figure 3:
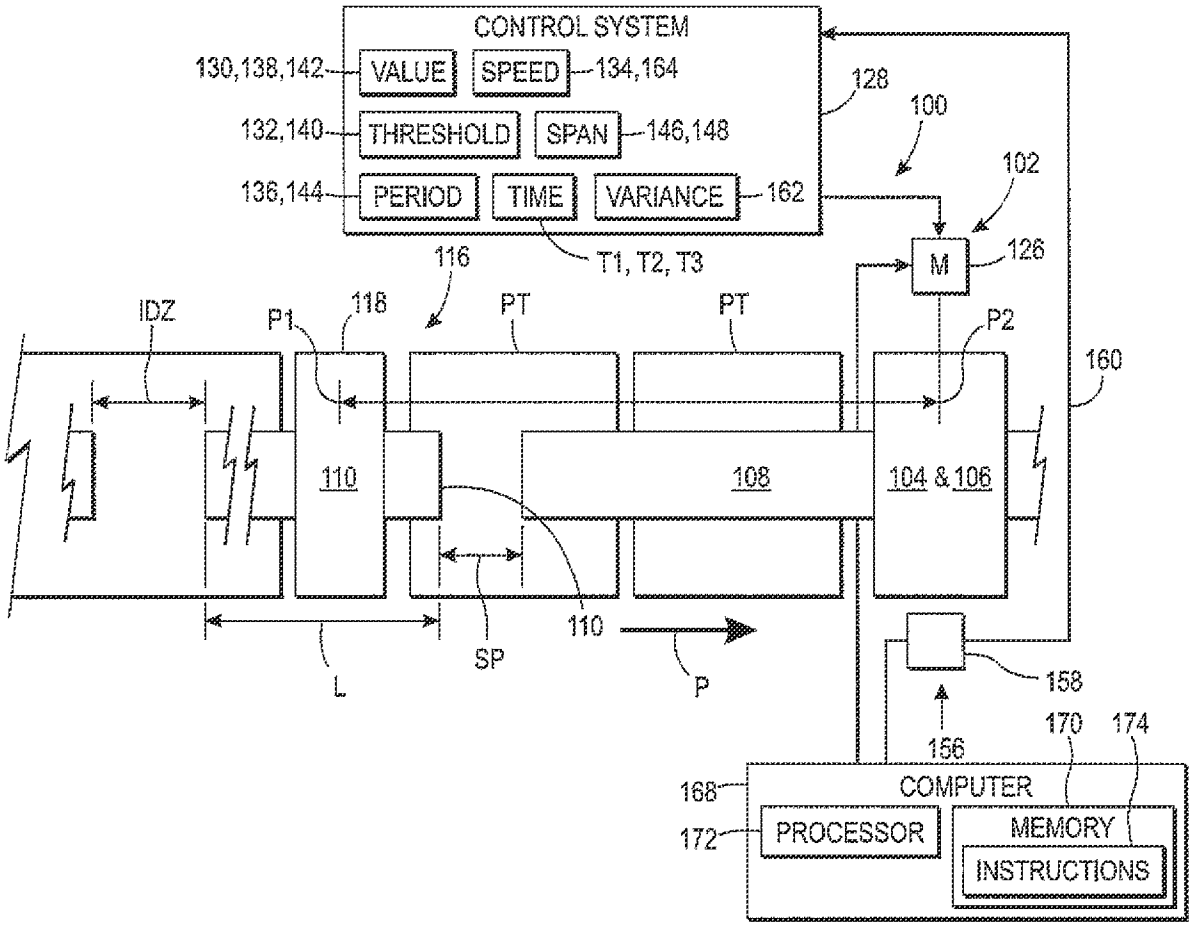
FIG. 3 is a schematic block diagram of the printer device in FIG. 1A.
Figure 4:
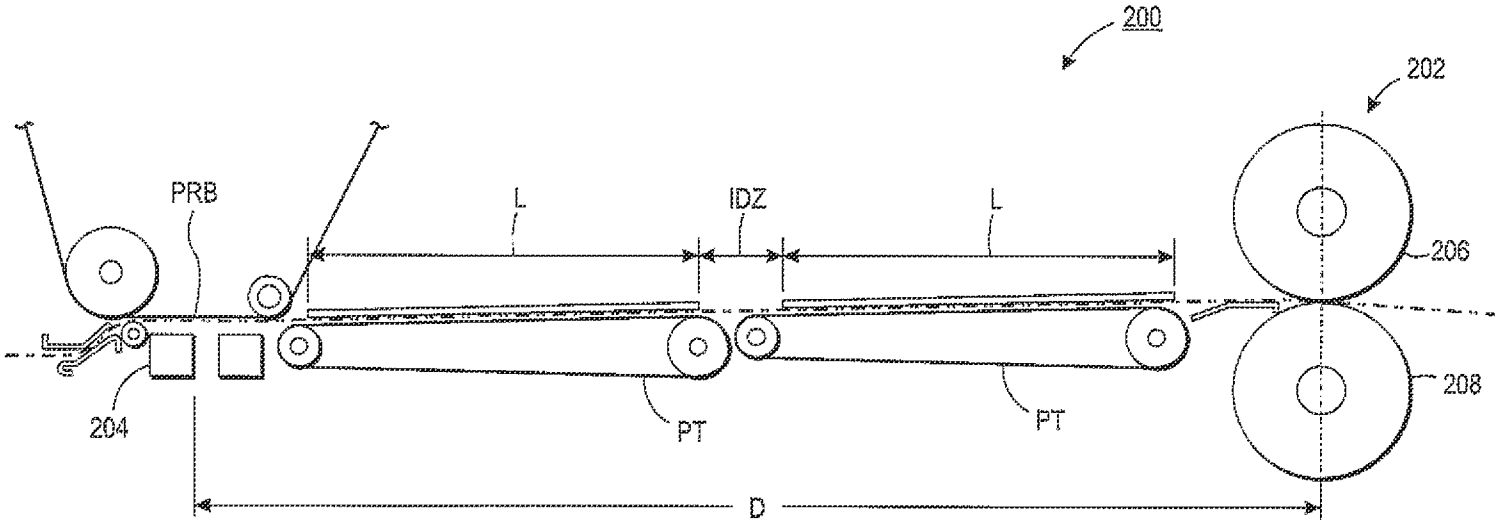
FIG. 4 PRIOR ART
FIG. 4 is a schematic detail of a prior art printer device.
Figure 5:
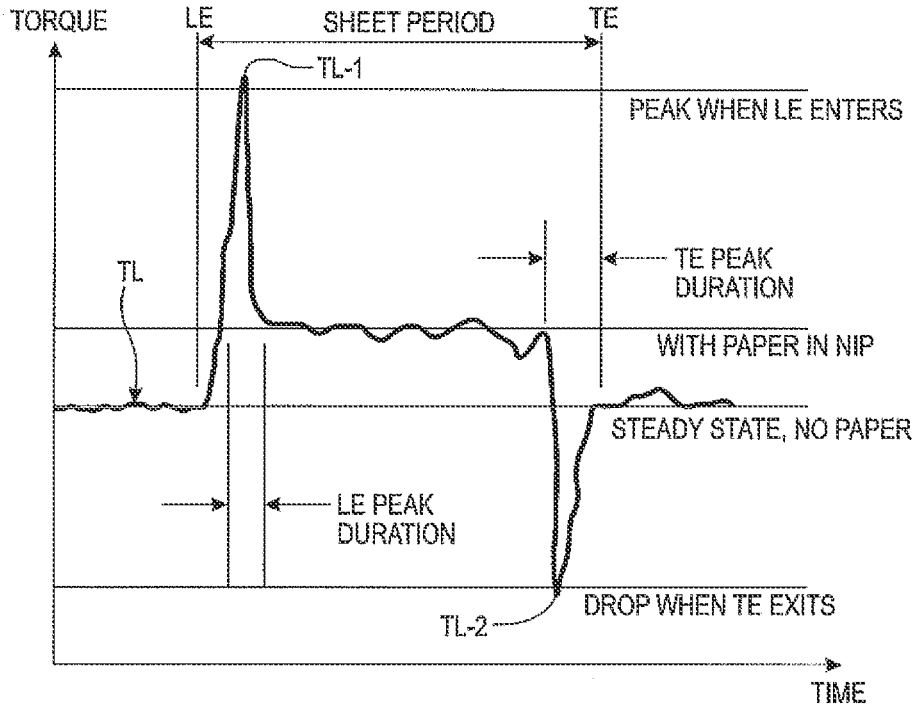
FIG. 5 PRIOR ART
FIG. 5 is a graph showing a torque load on the motor in FIG. 4 driving the fuser rollers; and, FIG. 6 is a graph showing fuser drive velocity for the fuser section of FIG. 4.
Figure 6:
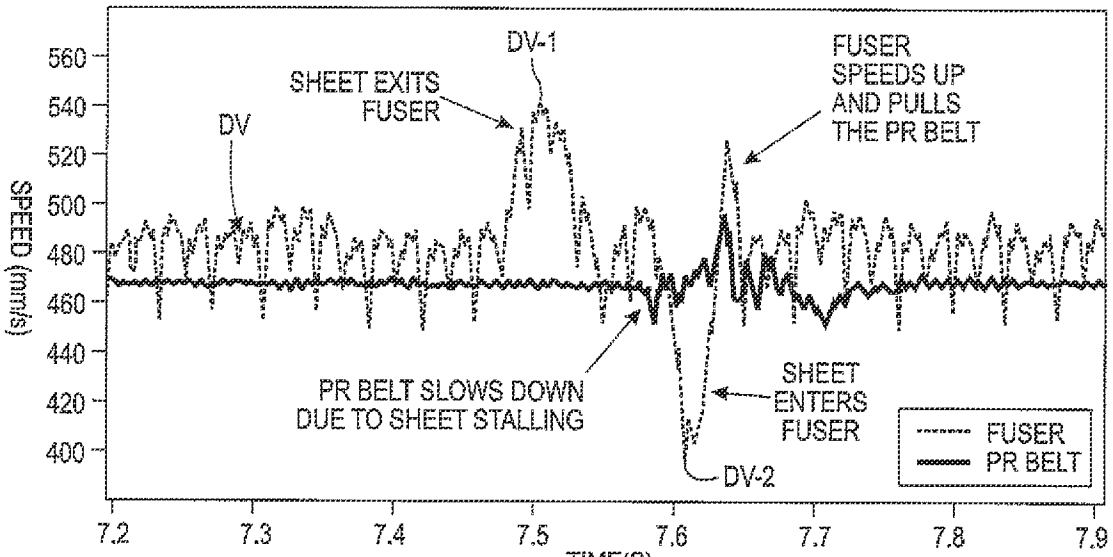
FIG. 6 PRIOR ART

FIG. 3 is a schematic block diagram of printer device 100. In an example embodiment, printer device 100 includes motor 126 and control system 128. Motor 126 is arranged to rotate fuser rollers 104 and 106 to displace sheets in process direction P. Torque generated by the motor increases when leading edges of sheets are engaged by fuser rollers 104 and 106 and torque generated by the motor decreases when trailing edges of sheets disengage from fuser rollers 104 and 106. Control system 128 is configured to measure torque, generated by the motor and according to measured torque values, control, or adjust, a speed at which fuser rollers 104 and 106 displace a sheet of material, modifying space SP between sheets. In particular, reducing inter-document zone spacing IDZ, which is maintained in section 116, as noted above, for quality control purposes.

Due to the constant speed at which section 116 transports sheets 108 and 110 in direction P, sheets of material are engaged by rollers 104 and 106 predetermined times T1. In an example embodiment, for a particular sheet, such as sheet 110, system 128 is configured to measure torque for the motor proximate predetermined time T1 for sheet 110.

The following describes an example sequence of detecting and adjusting for sheet 108 disengaging from rollers 104 and 106 prior to sheet 110 engaging rollers 104 and 106. The control system measures torque value 130, less than threshold value 132, prior to time T1. This signifies the too early disengagement of sheet 108 from rollers 104 and 106. To compensate for the early disengagement, the control system decreases speed 134 at which rollers 104 and 106 displace sheets in direction P so that for sheet 110 and sheets following sheet 110, respective disengagements coincides with respective engagements. In an example embodiment, to ensure that value 130 is for sheet 108 and not another sheet in the plurality of sheets, the control system determines that value 130 occurred within time period 136.

Thus, the control system is configured to decrease speed 134 so that spacing SP between successive upstream sheets, for example, sheets S1 and S2, is decreased as the successive sheet are displaced by fuser rollers 104 and 106. Thus, for example, due to the adjustment of speed 134, trailing edge TE of S1 disengages from fuser rollers 104 and 106 to match engagement of leading edge LE of S2 with fuser rollers 104 and 106. As a result, sheets S1 and S2 engage with and disengage from fuser rollers 104 and 106, respectively, substantially simultaneously.

The following describes an example sequence of detecting and adjusting for sheet 108 disengaging from rollers 104 and 106 after sheet 110 engages rollers 104 and 106. The control system measures torque value 138, greater than threshold value 140, at time T1 and measures torque value 142, less than threshold value 132 within time period 144 after time T1. This signifies the too late disengagement of sheet 108 from rollers 104 and 106. To compensate for the late disengagement, the control system increases speed 134 so that for sheet 110 and sheets following sheet 110, respective disengagements coincides with respective engagements. Time period 144 is determined to ensure that value 142 is for sheet 108 and not another sheet in the plurality of sheets.

Thus, the control system is configured to increase speed 134 so that spacing SP between successive upstream sheets, for example, sheets S1 and S2, is increased as the successive sheet are displaced by fuser rollers 104 and 106. Thus, for example, due to the adjustment of speed 134, trailing edge TE of S1 disengages from fuser rollers 104 and 106 to match engagement of leading edge LE of S2 with fuser rollers 104 and 106. As a result, sheets S1 and S2 engage with and disengage from fuser rollers 104 and 106, respectively, substantially simultaneously.

In an example embodiment, control system 128 is configured to calculate a decrease in speed 134 based on time span 146 between the occurrence of value 130 and time T1. In an example embodiment, control system 128 is configured to calculate an increase in speed 134 based on time span 148 between the occurrence of value 142 and time T1.

In an example embodiment, control system 128 is configured to detect trailing edge 112 with respect to position 156 proximate fuser rollers 104 and 106, for example, the point at which a sheet disengages from rollers 104 and 106. Detection at position 156 can be by any means known in the art. In an example, embodiment, detection is by sensor 158 proximate position 156. Sensor 158 can be any sensor device known in the art. Using signal 160 from sensor 158 the control system detects trailing edge 112 at time T2 and compares time T2 with predetermined time T3. Time T3 is the time associated with a substantially simultaneous engagement of sheet 110 with rollers 104 and 106 and disengagement of sheet 108 from rollers 104 and 106. For variance 162 between times T1 and T2, system 128 modifies speed 134.

In an example embodiment, when T2 is prior to T3, the control system is configured to decrease speed 134. In this instance, the trailing edge has disengaged from fuser rollers 104 and 106 too soon, for example, before leading edge 114 has engaged with fuser rollers 104 and 106. Speed 134 is decreased to delay disengagement of subsequent trailing edges, such as edge TE of sheet S1 to substantially coordinate the disengagement with the engagement of a sequential sheet, for example, the engagement of leading edge LE of sheet S2 with fuser rollers 104 and 106.

In an example embodiment, when T2 is after T3, the control system is configured to increase speed 134. In this instance, the trailing edge has disengaged from fuser rollers 104 and 106 too late, for example, after leading edge 114 has engaged with fuser rollers 104 and 106. Speed 134 is increased to speed disengagement of subsequent trailing edges, such as edge TE of sheet S1 to substantially coordinate the disengagement with the engagement of a sequential sheet, for example, the engagement of leading edge LE of sheet S2 with fuser rollers 104 and 106.

In an example embodiment, control system 128 is configured to operate transfer device 118 to displace sheets of material at constant speed 164 to create or maintain distance, or inter-document gap, IDZ, in process direction P between trailing edge 112 and leading edge 114. Control system 128 is configured to operate fuser rollers 104 and 106 to: engage leading edge 122 of sheet 108; displace sheet 108 at speed 134 less than speed 164 once sheet 108 disengages from transfer device 118; and reduce distance SP to enable the substantially simultaneous engagement of leading edge 114 and disengagement of trailing edge 112 described above.

In an example embodiment, printer device 100 includes at least one computer 168 with at least one memory element 170 and at least one processor 172. Element 170 is configured to store computer readable instructions 174. Processor 172 is configured to execute the computer readable instructions to displace, with fuser rollers 104 and 106, sheets of print material in process direction P. Processor 172 is configured to execute the computer readable instructions to substantially simultaneously disengage trailing edge 112 from fuser rollers 104 and 106 and engage leading edge 114, with fuser rollers 104 and 106. Processor 172 is configured to execute instructions 174 to implement the operations of rollers 104 and 106 described above.

Advantageously, printer device 100 enables the use of thicker and longer sheets of material by resolving the artifact problems described above, while simultaneously enabling necessary functions such as the quality control operations in the photoreceptor section. For example:

1. Slowing down sheet 108 enables adjustment of space SP between sheets 108 and 110 to coordinate engagement of sheet 110 with rollers 104 and 106 with disengagement of sheet 108 from rollers 104 and 106.

2. The speed at which transfer device 118 displaces sheets in direction P does not need to be adjusted, since all adjustment of space SP is done downstream of transfer device 118 in direction P.

3. While a sheet is simultaneously engaged with transfer device 118 and rollers 104 and 106, rollers 104 and 106 displace the sheet at the same speed in direction P as transfer device 118, avoiding crumpling or distorting the sheet.

4. Speed 134 is controllable to adjust for sheets having different lengths L and to adjust for any variations associated with various thicknesses for sheets of material.

5. Speed 134 is controllable in a closed-loop process (for example, monitoring torque or position of a sheet) that ensures operation within desired parameters.

It will be appreciated that various of the above-disclosed and other features and functions, or alternatives thereof, may be desirably combined into many other different systems or applications. Various presently unforeseen or unanticipated alternatives, modifications, variations, or improvements therein may be subsequently made by those skilled in the art which are also intended to be encompassed by the following claims.

What is claimed is:

1. A printing device, comprising:
a fuser section useful for printing operations;
first and second fuser rollers for the fuser section arranged to:
displace a plurality of sheets of print material in a process direction; and, simultaneously:
disengage from a trailing edge of a first sheet from the plurality of sheets; and,
engage a leading edge of a second sheet from the plurality of sheets; and,
a control system configured to:
detect, at a first time, the trailing edge of the first sheet at a position proximate the first and second fuser rollers;
compare the first time to a predetermined time; and,
for a variance between the first time and the predetermined time, modify a speed at which the first and second fuser rollers displace the plurality of sheets.

2. The device of claim 1, further comprising:
a photoreceptor section including a transfer device arranged to displace, at a constant speed, the plurality of sheets in the process direction toward the first and second fuser rollers, wherein:
a point at which a sheet from the plurality of sheets disengages from the transfer device and a point at which the sheet engages the first and second fuser rollers are separated by a distance in the process direction; and,
the sheet has a length, greater than the distance, in the process direction.

3. The device of claim 1, further comprising:
a photoreceptor section including a transfer device arranged to displace, at a constant speed, the plurality of sheets in the process direction toward the first and second fuser rollers, wherein:
the transfer device and the first and second fuser rollers are arranged to simultaneously engage the first sheet.

4. The device of claim 1, further comprising:
a photoreceptor section arranged to displace, at a constant speed, the plurality of sheets in the process direction toward the first and second fuser rollers, wherein:
the first and second fuser rollers are arranged to vary a speed at which the first and second fuser rollers displace the plurality of sheets in the process direction.

5. The device of claim 4, wherein:
the photoreceptor section includes a transfer device arranged to displace, at the constant speed, the plurality of sheets in the process direction toward the first and second fuser rollers; and,
the first and second fuser rollers are arranged to:
displace the first sheet at the constant speed while the first sheet is engaged with the transfer device and the first and second fuser rollers; and,
displace the first sheet at a first speed less than the constant speed after the first sheet disengages from the transfer device.

6. The device of claim 1, further comprising:
a motor arranged to rotate the first and second fuser rollers to displace the first sheet in the process direction; and,
a control system arranged to:
measure a torque produced by the motor; and,
according to a value of the measured torque, control a speed at which the first and second fuser rollers displace the plurality of sheets of print material in the process direction.

7. The device of claim 6, further comprising:
a photoreceptor section arranged to:
displace, at a constant speed, the plurality of sheets in the process direction toward the first and second fuser rollers; and,
transport the second sheet to the first and second fuser rollers at a predetermined time, wherein:
the control system is configured to measure the torque prior to the predetermined time; and,
when the value of the measured torque is less than a threshold value, the control system is configured to decrease a speed at which the first and second fuser rollers displace the plurality of sheets.

8. The device of claim 6, further comprising:
a photoreceptor section arranged to:
displace, at a constant speed, the plurality of sheets in the process direction toward the first and second fuser rollers; and,
transport the second sheet to the first and second fuser rollers at a predetermined time, wherein:
the control system is configured to measure the torque at the predetermined time and after the predetermined time; and,
when the value of the measured torque at the predetermined time is greater than a first threshold value and the value of the measured torque after the predetermined time is less than a second threshold value, the control system is configured to increase a speed at which the first and second fuser rollers displace the at least a portion of the plurality of sheets.

9. The device of claim 1, wherein the position is at a point in the process direction at which the plurality of sheets disengage from the first and second fuser rollers.

10. The device of claim 1, wherein:

when the first time is prior to the predetermined time, the control system is configured to decrease the speed at which the first and second fuser rollers displace the plurality of sheets; or, when the first time is after the predetermined time, the control system is configured to increase the speed at which the first and second fuser rollers displace the plurality of sheets.

11. The device of claim 1, further comprising:

a control system; and, a photoreceptor section, wherein:

the control system is configured to:

operate the photoreceptor section to:

displace, in the process direction, the first sheet; and, create or maintain a first distance, in the process direction, between the trailing edge of the first sheet and the leading edge of the second sheet; and, operate the first and second fuser rollers to:

engage a leading edge of the first sheet with the first and second fuser rollers;

reduce a speed at which the first and second fuser rollers displace the first sheet in the process direction; and, reduce the first distance between the first and second sheets to a second distance, less than the first distance, between the first and second sheets.

12. The device of claim 1, further comprising:

at least one computer including:

at least one memory element configured to store computer readable instructions; and, at least one processor configured to execute the computer readable instructions to:

displace, with the first and second fuser rollers, the plurality of sheets of print material in the process direction; and, simultaneously:

disengage, from the first and second fuser rollers, the trailing edge of the first sheet from the plurality of sheets; and, engage, with the first and second fuser rollers, the leading edge of the second sheet from the plurality of sheets.

13. A printing device, comprising:

a photoreceptor section arranged to displace a plurality of sheets of material at a constant speed in a process direction;

a fuser section useful for printing and having first and second fuser rollers arranged to:

displace a plurality of sheets of print material in the process direction;

vary a speed at which the first and second fuser rollers displace the plurality of sheets in the process direction; and, simultaneously:

disengage, from the first and second fuser rollers, a trailing edge of a first sheet in the plurality of sheets; and, engage, with the first and second fuser rollers, a leading edge of a second sheet from the plurality of sheets; and, a control system configured to:

detect, at a first time, the trailing edge of the first sheet at a position proximate the first and second fuser rollers;

compare the first time to a predetermined time and, for a variance between the first time and the predetermined time, modify the speed at which the first and second fuser rollers displace the plurality of sheets.

14. A printing device, comprising:

a photoreceptor section; and, a fuser section useful for printing and having first and second fuser rollers, wherein:

the photoreceptor section is arranged to:

displace, in a process direction toward the first and second fuser rollers, first and second sheets of print material; and, create or maintain a first distance, in the process direction, between a trailing edge of the first sheet and a leading edge of the second sheet; and, the first and second fuser rollers are arranged to reduce a speed at which the first and second fuser rollers displace the first sheet in the process direction;

reduce the first distance between the first and second sheets to a second distance between the first and second sheets; and, simultaneously:

disengage a trailing edge of the first sheet from the first and second fuser rollers; and, engage a leading edge of a second sheet of the print material with the first and second fuser rollers, wherein:

the photoreceptor section includes a transfer device arranged to displace the first and second sheets of print material in the process direction; and, the first and second fuser rollers are arranged to:

displace the first sheet at the constant speed while the first sheet is engaged with the transfer device; and, displace the first sheet at a first speed less than the constant speed after the first sheet disengages from the transfer device.

15. A printing device, comprising:

a fuser section useful for printing operations and including first and second fuser rollers;

a motor arranged to rotate the first and second fuser rollers to displace a plurality of sheets of material in a process direction; and, a control system configured to:

measure a torque produced by the motor and when a value of the measured torque is less than a threshold value:

determine that a sheet of material, included in the plurality of sheets of material, has disengaged from the first and second rollers prior to a desired time; and, decrease a speed at which the first and second fuser rollers displace the plurality of sheets of print material in the process direction; or, measure a torque produced by the motor and when a value of the measured torque is greater than a threshold value:

determine that a sheet of material, included in the plurality of sheets of material, is still engaged with the first and second fuser rollers; and, increase a speed at which the first and second fuser rollers displace the plurality of sheets of print material in the process direction.

16. A method for operating a printing device including a fuser device useful in printing and having first and second fuser rollers, comprising:

displacing, with the first and second fuser rollers, a plurality of sheets of print material in a process direction;

rotating, with a motor, the first and second fuser rollers to displace first and second sheets, included in the plurality of sheets, in the process direction;

simultaneously:

disengage, from the first and second fuser rollers, a trailing edge of the first sheet from the plurality of sheets; and, engage, with the first and second fuser rollers, a leading edge of the second sheet from the plurality of sheets;

detecting the trailing edge of the first sheet at a fixed position proximate the first and second fuser rollers at a first time comparing the first time to predetermined time and, for a variance between the first time and the predetermined time, modifying a speed at which the first and second fuser rollers displace the plurality of sheets.

17. The method of claim 16, wherein the printing device includes a photoreceptor section, the method further comprising:

displacing at a constant speed, with the photoreceptor section, the plurality of sheets in the process direction toward the first and second fuser rollers; and, varying a speed at which the first and second fuser rollers displace the plurality of sheets in the process direction.

18. The method of claim 16, further comprising:

displacing at a constant speed, with a transfer device included in a photoreceptor section, the plurality of sheets in the process direction toward the first and second fuser rollers; and, simultaneously engaging the first sheet with the transfer roller and the first and second fuser rollers.

19. The method of claim 16, further comprising:

displacing at a constant speed, with a transfer device included in a photoreceptor section, the plurality of sheets in the process direction toward the first and second fuser rollers;

displacing, with the first and second fuser rollers, the first sheet at the constant speed while the first sheet is engaged with the transfer device; and, displacing, with the first and second fuser rollers, the first sheet at a first speed less than the constant speed after the first sheet disengages from the transfer device.

20. The method of claim 16, further comprising:

rotating, with a motor, the first and second fuser rollers to displace the first and second sheets in the process direction;

measuring a torque produced by the motor; and, according to a value of the measured torque, controlling a speed at which the first and second fuser rollers displace at least a portion of the plurality of sheets of print material in the process direction.

21. The method of claim 20, further comprising:

displacing, at a constant speed and with a photoreceptor section, the plurality of sheets in the process direction toward the first and second fuser rollers;

transporting the second sheet, with the photoreceptor section, to the first and second fuser rollers at a predetermined time measuring the torque at the predetermined time; and, for the value of the measured torque being greater than a threshold value, decreasing a speed at which the first and second fuser rollers displace the at least a portion of the plurality of sheets.

22. The method of claim 20, further comprising:

displacing, at a constant speed and with a photoreceptor section, the plurality of sheets in the process direction toward the first and second fuser rollers;

transporting the second sheet, with the photoreceptor section, to the first and second fuser rollers at a predetermined time;

measuring the torque prior to the predetermined time and after the predetermined time;

determining that the value of the measured torque at the predetermined time is greater than a first threshold value;

determining that the value of the measured torque after the predetermined time is less than a second threshold value; and, increasing a speed at which the first and second fuser rollers displace the at least a portion of the plurality of sheets.

23. The method of claim 16, further comprising:

when the first time is prior to the predetermined time, decreasing the speed at which the first and second fuser rollers displace the plurality of sheets; or, when the first time is after the predetermined time, increasing the speed at which the first and second fuser rollers displace the plurality of sheets.

24. The method of claim 16, further comprising:

displacing, with a photoreceptor section and in the process direction, the first sheet;

creating or maintaining a first distance, in the process direction between the trailing edge of the first sheet and the leading edge of the second sheet;

engaging a leading edge of the first sheet with the first and second fuser rollers;

reducing a speed at which the first and second fuser rollers displace the first sheet in the process direction; and, reducing the first distance between the first and second sheets to a second distance between the first and second sheets.

25. The method of claim 16, further comprising:

storing, in at least one memory element of at least one computer, computer readable instructions; and, executing, using at least one processor for the at least one computer, the computer readable instructions to:

displace, with the first and second fuser rollers, the plurality of sheets of print material in the process direction; and, simultaneously:

disengage, from the first and second fuser rollers, the trailing edge of the first sheet from the plurality of sheets; and, engage, with the first and second fuser rollers, the leading edge of the second sheet from the plurality of sheets.

26. A method for operating a printing device including a photoreceptor section, and a fuser section useful for printing and having first and second fuser rollers, the method comprising:

displacing a plurality of sheets of print material in a process direction with the photoreceptor section;

varying a speed at which the first and second fuser rollers displace the plurality of sheets in the process direction;

simultaneously:

disengaging, from the first and second fuser rollers, a trailing edge of a first sheet in the plurality of sheets; and, engaging, with the first and second fuser rollers, a leading edge of a second sheet from the plurality of sheets, detecting, using a control system and at a first time, the trailing edge of the first sheet at a position proximate the first and second fuser rollers;

comparing, using the control system, the first time to a predetermined time; and, for a variance between the first time and the predetermined time, modifying, using the control system, a speed at which the first and second fuser rollers displace the plurality of sheets.

27. The method of claim 26, further comprising:

displacing at a constant speed, with the photoreceptor section, the plurality of sheets of material in the process direction toward the first and second fuser rollers.

28. A method for operating a printing device including a photoreceptor section, and a fuser section useful for printing and having first and second fuser rollers, the method comprising:

displacing, in a process direction toward the first and second fuser rollers, first and second sheets of print material with the photoreceptor section;

creating or maintaining a first distance, in the process direction, between a trailing edge of the first sheet and a leading edge of the second sheet;

reducing a speed at which the first and second fuser rollers displace the first sheet in the process direction;

reducing the first distance between the first and second sheets to a second distance between the first and second sheets;

simultaneously:

disengaging a trailing edge of the first sheet from the first and second fuser rollers; and, engaging a leading edge of a second sheet of the print material with the first and second fuser rollers;

displacing, using a transfer device included in the photoreceptor section, the first and second sheets of print material in the process direction; and, with the first and second fuser rollers:

displacing the first sheet at the constant speed while the first sheet is engaged with the transfer device; and, displacing the first sheet at a first speed less than the constant speed after the first sheet disengages from the transfer device.

29. The method of claim 28, wherein:

the photoreceptor section includes a transfer device; and, the first and second fuser rollers are arranged to:

displace the first sheet at the constant speed while the first sheet is engaged with the transfer device;

displace the first sheet at a first speed less than the constant speed after the first sheet disengages from the transfer device; and, displace the first and second sheets at the constant speed when the second sheet engages the first and second fuser rollers.

30. A method for operating a printing device including a fuser section useful for printing and having first and second fuser rollers and a motor for rotating the first and second fuser rollers, the method comprising:

rotating the first and second fuser rollers;

displacing, with the first and second fuser rollers, first and second sheets of material, from a plurality of sheets of material, in a process direction;

measuring a torque produced by the motor; and, when a value of the measured torque is less than a threshold value:

determining that a sheet of material, included in the plurality of sheets of material, has disengaged from the first and second rollers prior to a desired time; and, decreasing a speed at which the first and second fuser rollers displace the plurality of sheets of print material in the process direction; or, when a value of the measured torque is greater than a threshold value:

determining that a sheet of material, included in the plurality of sheets of material, is still engaged with the first and second fuser rollers; and, increasing a speed at which the first and second fuser rollers displace the plurality of sheets of print material in the process direction.

* * * * *

UNITED STATES PATENT AND TRADEMARK OFFICE

CERTIFICATE OF CORRECTION

PATENT NO. : 9,152,101 B2
APPLICATION NO. : 14/093879
DATED : October 6, 2015
INVENTOR(S) : Steven M Russel et al.

It is certified that error appears in the above-identified patent and that said Letters Patent is hereby corrected as shown below:

Item 71 in the Applicants on the title page of the patent, "Xerox Corporation, Norwalk, CT (US); Chester Paul Maliszewski" should read "Xerox Corporation, Norwalk, CT (US)".

Signed and Sealed this
Seventeenth Day of May, 2016

Michelle K. Lee

Michelle K. Lee
*Director of the United States Patent and Trademark Office*